US006288525B1

(12) United States Patent
Fischer

(10) Patent No.: US 6,288,525 B1
(45) Date of Patent: Sep. 11, 2001

(54) MERGED NPN AND PNP TRANSISTOR STACK FOR LOW NOISE AND LOW SUPPLY VOLTAGE BANDGAP

(75) Inventor: Jonathan Fischer, Longmont, CO (US)

(73) Assignee: Agere Systems Guardian Corp., Miami Lakes, FL (US)

( * ) Notice: Subject to any disclaimer, the term of this patent is extended or adjusted under 35 U.S.C. 154(b) by 0 days.

(21) Appl. No.: 09/708,342

(22) Filed: Nov. 8, 2000

(51) Int. Cl.[7] ..... G05F 3/16; G05F 3/20
(52) U.S. Cl. ..... 323/313; 323/316
(58) Field of Search ..... 323/313, 314, 323/315, 316

(56) References Cited

U.S. PATENT DOCUMENTS

| | | | | |
|---|---|---|---|---|
| Re. 35,951 | | 11/1998 | Ganesan et al. . | |
| 4,339,707 | | 7/1982 | Gorecki . | |
| 4,595,874 | | 6/1986 | Hein et al. . | |
| 4,897,595 | * | 1/1990 | Holle | 323/314 |
| 5,568,045 | * | 10/1996 | Koazechi | 323/314 |
| 5,867,012 | * | 2/1999 | Tuthill | 323/313 |
| 6,031,365 | | 2/2000 | Sharpe-Geisler . | |

OTHER PUBLICATIONS

Paul R. Gray and Robert G. Meyer (University of California, Berkeley), *Analysis and Design of Analog Integrated Circuits*, ® 1977, 1984, by John Wiley & Sons, Inc., Canada and USA, pp. 289–296 (with cover page and copyright page, total 10 pages).

* cited by examiner

*Primary Examiner*—Peter S. Wong
*Assistant Examiner*—Bao Q. Vu
(74) *Attorney, Agent, or Firm*—Duane, Morris & Heckscher LLP; Joseph F. Oriti

(57) ABSTRACT

A low noise band-gap voltage reference utilizes pairs of NPN and PNP transistors operable with supply voltages of less than 3 volts. This voltage reference utilizes pairs of bipolar transistors. Each pair has a NPN and a PNP transistor configured such that the base of the NPN transistor is coupled to the emitter of the PNP transistor. The base of the PNP transistor of each pair is coupled to the emitter of the NPN transistor of another pair. Collectors and emitters of the transistors are coupled to current sources providing current proportional to absolute temperature. The transistors are configured such that the largest voltage developed across the core of transistor pair is approximately equal to the band-gap voltage.

11 Claims, 3 Drawing Sheets

MERGED NPN AND PNP TRANSISTOR STACK FOR LOW NOISE AND LOW SUPPLY VOLTAGE BANDGAP

FIELD OF THE INVENTION

The present invention relates to electronic circuits, specifically to band-gap voltage reference circuits.

BACKGROUND

Band-gap voltage regulators are typically used to provide substantially constant reference voltages in environments subject to temperature fluctuation. Generally, band-gap circuits develop a voltage proportional to the difference between base-to-emitter voltages, $\Delta V_{BE}$, of two transistors to compensate for the temperature variation in the transistor base-emitter voltage to develop a temperature compensated output voltage. Because $\Delta V_{BE}$ is small (e.g., less than 100 mV), it is amplified to compensate the temperature variation in $V_{BE}$. A disadvantage of amplifying $\Delta V_{BE}$ is that circuit noise is also amplified.

In U.S. Pat. No. Re. 35,951, issued to Ganesan et al., in an attempt to reduce noise, transistors are stacked to reduce the amount of amplification needed. Stacking transistors reduces the amplification needed and also reduces noise because, the $\Delta V_{BE}$'s add directly and the noise from each transistor adds on a power basis. Because power is proportional to voltage squared, the ratio of the output voltage (after amplification) to noise increases (improves) by the square root of the number of stacked transistors.

Greater $\Delta V_{BE}$ values have been produced by stacking like transistor types. For example, stacking NPN transistors, stacking PNP transistors, and amplifying the difference in the cumulative $\Delta V_{BE}$'s of each stack. This is illustrated in FIG. 1. In FIG. 1, NPN transistors are stacked together and PNP transistors are stacked together. For example, NPN transistors Q29, Q31, Q33, and Q35 are stacked together and PNP transistors Q21, Q23, Q25, and Q27 are stacked together.

A problem with this approach is that the minimum supply voltage needed to power a stack increases as the number of transistors in the stack increases. As previously stated, increasing the number of transistors in a stack decreases noise, but increasing the number of transistors in a stack also increases the minimum supply voltage required. Thus, a need exists for a low noise band-gap reference voltage that operates with a low supply voltage.

SUMMARY OF THE INVENTION

An electronic circuit comprises a plurality of transistor pairs, having a first transistor pair and a last transistor pair. Each transistor pair comprises a first transistor having a first emitter, a first collector, and a first base, and a second transistor having a second emitter, a second collector, and a second base. The first transistor of each transistor pair is a NPN bipolar transistor and the second transistor of each transistor pair is a PNP bipolar Lransistor. Each second emitter is capable of being electrically coupled to a first current supply means. Each first emitter is capable of being electrically coupled to a second current supply means. Each first collector is capable of being electrically coupled to a first voltage, and each second collector is capable of being electrically coupled to a second voltage. Within each pair, the first base is electrically coupled to the second emitter. Each second base, with the exception of the second base of the first pair and the second base of the last pair, is electrically coupled to the first emitter of another one of the plurality of transistor pairs, respectively. The second base of the first pair is electrically coupled to the second collector of the first pair, and the second base of the last pair is electrically coupled to the second collector of the last pair. The electronic circuit also comprises a differential amplifier. The differential amplifier has a first input terminal, a second input terminal, and an output terminal. The first input terminal is electrically coupled to one of two first emitters not electrically coupled to one of the second bases. The second input terminal is electrically coupled to the other one of two first emitters not electrically coupled to one of the second bases. The output terminal is electrically coupled to the second base and the second collector of either the last transistor pair or the first transistor pair.

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawings. It is emphasized that, according to common practice, the various features of the drawings may not be to scale. On the contrary, the dimensions of the various features may be arbitrarily expanded or reduced for clarity. Included in the drawing are the following figures.

DETAILED DESCRIPTION OF THE INVENTION

Figure 1:
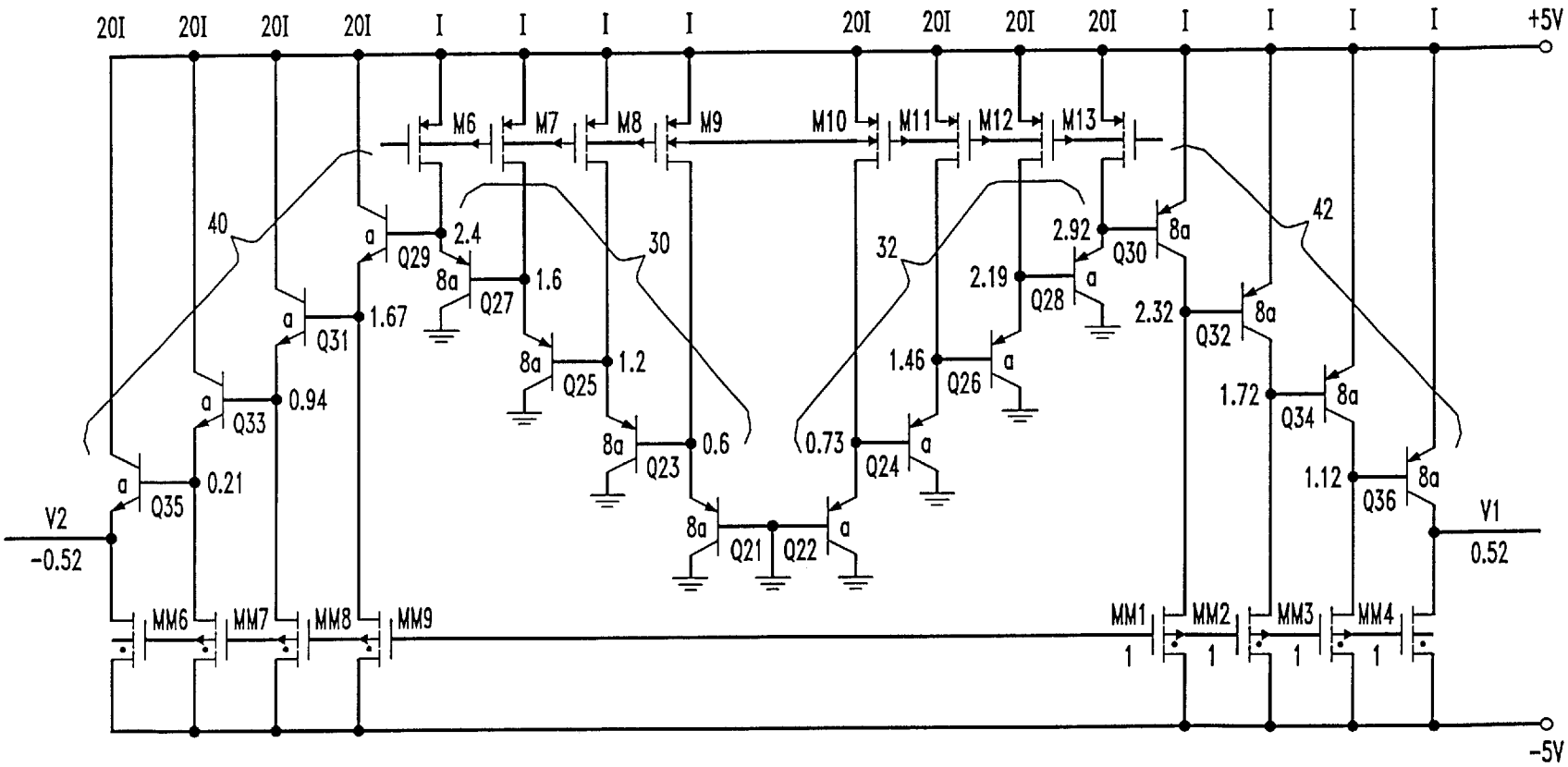
FIG. 1 PRIOR ART
FIG. 1 (Prior Art) is circuit diagram of a band-gap reference circuit having stacked transistors of the same type.
Figure 2:
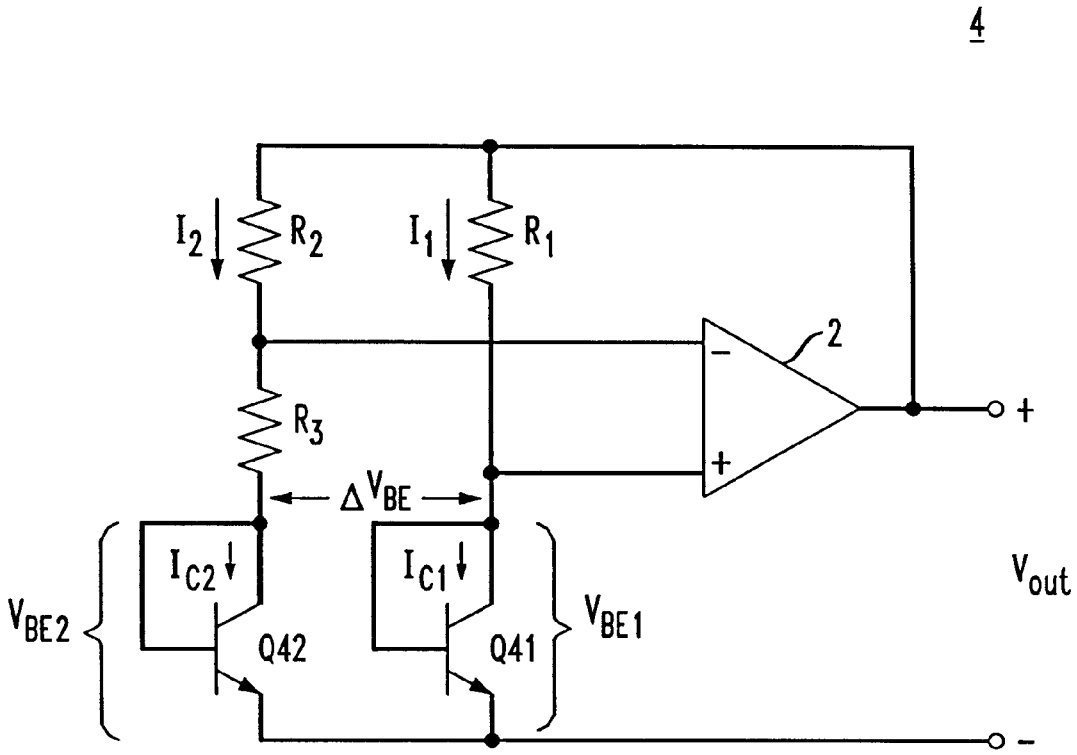
FIG. 2 PRIOR ART
FIG. 2 (Prior Art) is a circuit diagram of a basic band-gap voltage reference circuit.

A band-gap voltage reference provides an output voltage, which is stable and essentially temperature independent. FIG. 2 is a circuit diagram of a basic band-gap reference circuit generally designated 4. As described below, the output voltage (i.e., the band-gap reference voltage) of circuit 4, $V_{out}$, comprises two terms: $V_{BE1}$ and $KV_T$. The first term, $V_{BE1}$ has a negative temperature coefficient approximately −2 mV/degree (Centigrade or Kelvin), and the second term, $KV_T$, has a positive temperature coefficient proportional to degrees Kelvin. In operation, to provide a reference voltage independent of temperature, the value of K is adjusted to ensure that a change in voltage in the first term due to change in temperature is equal and opposite to the change in voltage in the second term due to temperature.

$V_{out}$, in circuit 4, is a function of the difference in base-emitter voltages, $\Delta V_{BE}$, of the base-emitter voltage of transistor Q41, $V_{BE1}$, and the base-emitter voltage of transistor Q42, $V_{BE2}$. Under stable operating conditions, the voltages at the input terminals of operational amplifier 2 are approximately equal. Thus, the differential input voltage of operational amplifier 2 is zero. Because each of resistors $R_1$ and $R_2$ is electrically coupled to respective input terminals of operational amplifier 2, the voltages across $R_1$ and $R_2$ are equal. The relationship between temperature and $\Delta V_{BE}$ can be determined from the relationship between collector current and base-emitter voltage of a bipolar transistor.

The relationship between collector current, $I_C$, and base-emitter voltage, $V_{BE}$, is in accordance with the following equations.

$$I_C=I_S e^{VBE/VT} \quad (1)$$

and $$V_T=kT/q, \quad (2)$$

where $I_C$ is collector current, $I_S$ is saturation current, k is Boltzmann's constant, T is the temperature in Kelvin, and q is the charge of an electron. Solving equation (1) for $V_{BE}$ results in:

$$V_{BE}=V_T \ln(I_C/I_S) \quad (3)$$

In FIG. 2, $\Delta V_{BE}$ is the difference between $\Delta V_{BE1}$ and $\Delta V_{BE2}$. Thus, $$\Delta V_{BE}=V_{BE1}-V_{BE2}=V_T \ln(I_{C1}/I_{S1}*I_{S2}/I_{C2}), \quad (4)$$

where $I_{C1}$ is the collector current of transistor Q41, $I_{S1}$ is the saturation current of transistor Q41, $I_{C2}$ is the collector current of transistor Q42, and $I_{S2}$ is the saturation current of transistor Q42.

Neglecting the small base currents in transistors Q41 and Q42, current $I_1$ is equal to $I_{C1}$ and current $I_2$ is equal to $I_{C2}$. Also, because the same voltage potential exists across both $R_1$ and $R_2$, the ratio of currents $I_1$ and $I_2$ is equal to the ratio of resistance $R_2$ and $R_1$. Thus, equation (4) may be rewritten as follows:

$$\Delta V_{BE}=V_T \ln(I_1/I_2\times I_{S1}/I_{S2})=V_T \ln(R_2/R_1\times I_{S2}/I_{S1}) \quad (5)$$

$\Delta V_{BE}$ is the voltage across $R_3$. Therefore, the current flowing through $R_3$ is $\Delta V_{BE}/R_3$. This is also the current through $R_2$. Thus, the voltage across $R_2$ is $(R_2/R_3)\Delta V_{BE}$. This is also the voltage across $R_1$. The output voltage is the sum of the voltage across $R_1$ and the voltage across transistor Q41. Thus, $$V_{out}=V_{BE1}+(R_2/R_3)\Delta V_{BE}=V_{BE1}+(R_2/R_3)V_T \ln(R_2/R_1\times I_{S2}/I_{S1}), \quad (6)$$

or, written alternatively:

$$V_{out}=V_{BE1}+KV_T \quad (7)$$

As can be seen in equation (7), $V_{out}=V_{BE1}+KV_T$, and as described previously, the temperature coefficients of each term differ, allowing for a temperature independent output voltage. Also, note that $$K=(R_2/R_3)\ln(R_2/R_1\times I_{S2}/I_{S1}). \quad (8)$$

Thus, specific values of K may be obtained by adjusting the ratios of $R_2/R_3$ and $R_2/R_1$, given the ratio of $I_{S2}/I_{S1}$.

Figure 3:
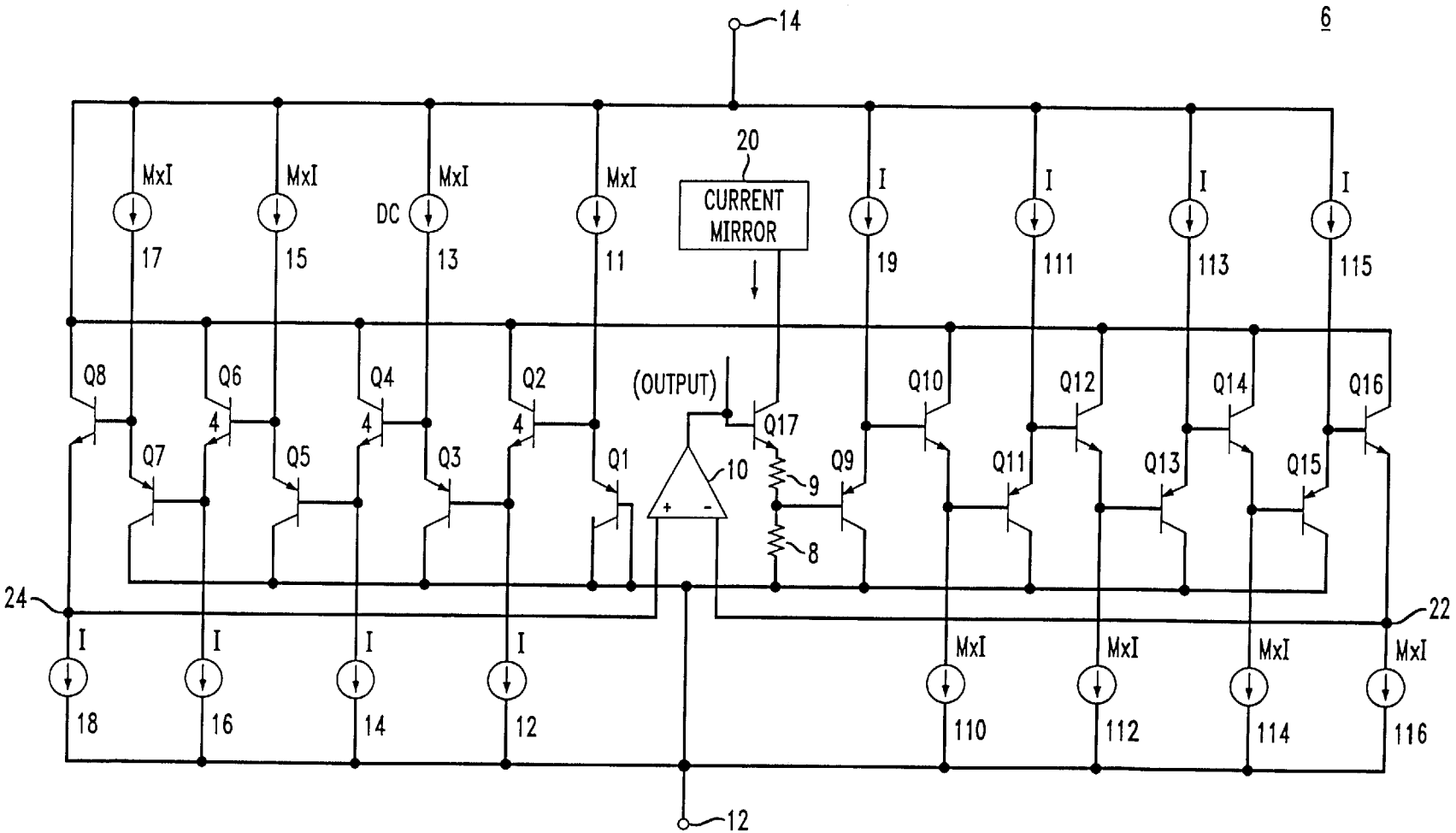
FIG. 3 is a circuit diagram of an exemplary embodiment of a band-gap voltage reference circuit in accordance with the present invention.

FIG. 3 is a circuit diagram of an embodiment of a band-gap voltage reference circuit in accordance with the present invention generally designated 6. The circuit 6 comprises several transistor pairs. The transistor pairs shown in circuit 6 are (from left to right) Q8 and Q7, Q6 and Q5, Q4 and Q3, Q2 and Q1, Q9 and Q10, Q11 and Q12, Q13 and Q14, and Q15 and Q16. Each transistor pair comprises a PNP and a NPN transistor. In an exemplary embodiment of the invention, each transistor is a parasitic bipolar transistor formed in an integrated circuit. Band-gap voltage references are particularly useful in integrated circuits. Often, in complimentary metal oxide semiconductor (CMOS) technology, bipolar transistors are formed parasitically. For example, in P-substrate CMOS technology, a parasitic substrate transistor may be formed by the P−/P+ diffusion region formed within an N-type region, formed within the P-substrate. The parasitic PNP transistor is also available in standard junction isolated NPN processes. The NPN transistor is added to CMOS to make a Bi-CMOS process.

In each transistor pair, the base of the NPN transistor is electrically coupled to the emitter of the PNP transistor. For example, the base of Q8 is electrically coupled to the emitter of Q7. The base of each PNP transistor is electrically coupled to the emitter of the NPN transistor in another transistor pair, with the exception of the bases of transistors Q1 and Q9. The base of transistor Q9 is electrically coupled to its collector, and the base of transistor Q1 is electrically coupled to its collector. In the embodiment of the invention shown in circuit 6, the base of transistor Q9 is electrically coupled to its collector through resistor 8.

The emitter of each of transistors Q1 through Q16 is electrically coupled to respective current sources I1 through I16. For example, the emitter of transistor Q7 is electrically coupled to current source I6. Current sources I1 through I16 may be any current source known in the art, including metal oxide semiconductor (MOS) current sources. The collectors of transistors Q7, Q5, Q3, Q1, Q9, Q11, Q13, and Q15 are electrically coupled to voltage 12. In one embodiment of the invention, voltage 12 is equal to zero volts (e.g., ground). Voltage may also be a negative voltage. The collectors ol transistors Q2, Q4, Q6, Q8, Q10, Q12, Q14, and Q16 are electrically coupled to voltage 14. In one embodiment of the invention voltage 14 is at a higher voltage (e.g., positive supply voltage) than voltage 12.

The emitters of transistors Q8 and Q16 are each electrically coupled to respective input terminals of differential amplifier 10. In the embodiment of the invention shown in circuit 6, the emitter of transistor Q8 is electrically coupled to the positive input terminal of differential amplifier 10 and the emitter of transistor Q16 is electrically coupled to the negative terminal of differential amplifier 10. The output terminal of differential amplifier 10 provides the output voltage (i.e., band-gap reference voltage). The output terminal of differential amplifier 10 is electrically coupled to the base of transistor Q17 and to one end of resistor 8. The emitter of transistor Q17 is electrically coupled to the base of transistor Q9. The collector of transistor Q17 is electrically coupled to current source 20. In the embodiment of the invention depicted in circuit 6, current source 20 is a current mirror, which controls current sources I1 through I16. Current sources I1 through I16 are proportional to the current being provided by current source 20. In an exemplary embodiment of the invention, current sources I2, I4, I6, I8, I9, I11, I13, and I15 provide current equal to the current provided by current source 20. Current sources I1, I3, I5, I7, I10, I12, I14, and I16 provide current equal to M times the current provided by current source 20, where M is a real number.

The NPN and PNP transistors in circuit 6 are configured such that the total cumulative difference in base-emitter voltage across the configuration (i.e., $\Delta V_{BE}$) is approximately equal to the $KV_T$ term of equation (7) without requiring additional amplification. Developing a total cumulative $\Delta V_{BE}$ as shown in FIG. 3, reduces the amount of amplification, thus reducing noise amplification. In each transistor pair, one transistor of the pair has an emitter current value of I, and the other transistor has an emitter current value of M×I. For example, in the transistor pair comprising transistors Q8 and Q7, transistor Q8 has an emitter current value of I, as provided by current source I8, and transistor Q7 has an emitter current value of M×I, as provided by current source I7. Accordingly, the base-emitter voltage, $V_{BE}$, for transistor Q8 differs from the base-emitter voltage, $V_{BE}$, for transistor Q7. The individual base-emitter voltage differences created in each pair add cumulatively. Transistors Q1 through Q8 create a cumulative $\Delta V_{BE}$, which is approximately equal in magnitude and opposite in polarity to the cumulative $\Delta V_{BE}$ created by transistors Q9 through Q16. Thus, given the value of the saturation currents ($I_S$) of each transistor, the values of M and I may be adjusted to obtained a cumulative voltage across the transistors equal to the $KV_T$ portion of the output voltage.

Analogous to circuit 4 in FIG. 2, where feedback is provided from the output terminal of differential amplifier 2 through resistors $R_1$ and $R_2$, feedback in circuit 6 of FIG. 3 is provided from the output terminal of differential amplifier 10, through transistor Q17 and resistor 8. In circuit 6, under stable operating conditions, the voltage developed across points 22 and 24 is approximately zero, accordingly the total cumulative $\Delta V_{BE}$ is developed across resistor 8. Current source 20 provides a current ($\Delta V_{BE}$/R8) that is proportional to absolute temperature (IPTAT). Because this current flows through resistor 8, the total cumulative amplified $\Delta V_{BE}$ developed across resistor 8 is also proportional to absolute current. Further, driving transistors Q1 through Q17 with a current that is proportional to absolute temperature reduces the temperature coefficient of $\Delta V_{BE}$. This current source may be any IPTAT source known in the art.

Optional resistor 9 provides fine adjustment of the output voltage temperature coefficient. The output voltage is:

$$V_{OUT}=V_{BE17}+(R9/R8+1)\Delta V_{BE}, \quad (9)$$

where, $V_{OUT}$ is the voltage at the output terminal of differential amplifier 10, $V_{BE17}$ is the base-emitter voltage of transistor Q17, R8 is resistor 8, and R9 is resistor 9. It is advantageous to design $\Delta V_{BE}$ to be equal to or slightly less than the $KV_T$ term of equation (7) to compensate $V_{BE17}$ for temperature. The value of resistors 8 and 9 may be adjusted to adjust the temperature coefficient. This adjustment accounts for process variation in the amount of $\Delta V_{BE}$ needed to compensate $V_{BE17}$ for temperature. The amplification of $\Delta V_{BE}$ noise associated with resistor 9 may be minimized by using the appropriate value of $\Delta V_{BE}$. Thus, the scaling of the $\Delta V_{BE}$ noise contribution due to resistor 9 may be minimized by designing the value of $\Delta V_{BE}$ to be large enough such that resistor 9 may be zero at one process extreme, and also such that the value of resistor 9 may be increased to cover the remainder of the process variation.

Because the voltage across the configuration of the NPN and PNP transistors in circuit 6 is approximately equal to the band-gap voltage, a power supply having a voltage slightly greater than the band-gap voltage may be used. For example the circuit 6 may be operated with supply voltages less than 3 volts. Further, configuring NPN and PNP transistor; as shown in circuit 6 provides a low noiseband-gap reference voltage utilizing fewer transistors than previous attempts. Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. An electronic circuit comprising:

a plurality of transistor pairs having a first transistor pair and a last transistor pair, each transistor pair comprising a first transistor having a first emitter, a first collector, and a first base, and a second transistor having a second emitter, a second collector, and a second base, said first transistor of each transistor pair being an NPN bipolar transistor and said second transistor of each transistor pair being a PNP bipolar transistor; each second emitter being capable of being electrically coupled to a first current supply means, each first emitter being capable of being electrically coupled to a second current supply means; each first collector being capable of being electrically coupled to a first voltage, each second collector being capable of being electrically coupled to a second voltage; wherein;

within each pair, said first base is electrically coupled to said second emitter;

each second base, with the exception of the second base of the first pair and the second base of the last pair, is electrically coupled to the first emitter of another one of said plurality of transistor pairs, respectively; and said second base of said first pair is electrically coupled to said second collector of said first pair, and said second base of said last pair is electrically coupled to said second collector of said last pair; and a differential amplifier having a first input terminal, a second input terminal, and an output terminal, said first input terminal being electrically coupled to one of two first emitters not electrically coupled to one of the second bases, said second input terminal being electrically coupled to the other one of two first emitters not electrically coupled to one of the second bases, and said output terminal being electrically coupled to said second base and said second collector of one of said last transistor pair and said first transistor pair.

2. An electronic circuit in accordance with claim 1, further comprising said first voltage electrically coupled to each first collector and said second voltage electrically coupled to each second collector.

3. An electronic circuit in accordance with claim 1 further comprising:

a resistor electrically coupled between one of said second base and said second collector of said first transistor pair, and said second base and said second collector of said last transistor pair, wherein an end of said resistor is electrically coupled to one of said second bases, said end being a base end of said resistor; and an output transistor having a base and two current carrying electrodes, wherein, said base is electrically coupled to said output terminal of said differential amplifier, and one of said two current carrying electrodes is electrically coupled to said base end of said resistor and the other one of said two current carrying electrodes is capable of being electrically coupled to a third current supply means.

4. An electronic circuit in accordance with claim 3 further comprising an adjustment resistor electrically coupled between said base end of said resistor and said emitter of said output transistor.

5. An electronic circuit in accordance with claim 3 further comprising said first current supply means electrically coupled to each second emitter, said second current supply means electrically coupled to each first emitter, and said third current supply means electrically coupled to said other one of said two current carrying electrodes.

6. An electronic circuit in accordance with claim 5, wherein said third current supply means is a current mirror.

7. An electronic circuit in accordance with claim 5, wherein said first current supply means comprises individual current supply means electrically coupled to each second emitter and said second supply means comprises individual current supply means electrically coupled to each first emitter.

8. An electronic circuit in accordance with claim 7 wherein said third current supply means provides current equal to I amperes being proportional to absolute temperature, and values of current provided by said first current means and said second current means are proportional to I.

9. An electronic circuit in accordance with claim 8 wherein current provided to said first transistors of half of said plurality of transistor pairs is equal to I amperes and current provided to said second transistors of said half if equal to M×I amperes, and current provided to said first transistors of a remainder of said plurality of transistor pairs is equal to M×I and current, provided to said second transistors of said remainder is equal to I amperes, wherein M is a real number.

10. An electronic circuit in accordance with claim 1, wherein said electronic circuit is an integrated circuit.

11. An electronic circuit in accordance with claim 10, wherein at least one of said bipolar transistors is parasitic.

* * * * *